US007096611B2

(12) United States Patent
Maudhuit et al.

(10) Patent No.: US 7,096,611 B2
(45) Date of Patent: Aug. 29, 2006

(54) IRON COMPRISING A WATER RESERVOIR WHICH IS PROVIDED WITH A FILLING ORIFICE ON THE REAR FACE OF SAID IRON

(75) Inventors: Sylvain Maudhuit, Pisieu (FR); Michel Jouvel, Chaponost (FR); Christian Giovalle, Moidieu de Tourbe (FR); Michel Aloth, Moissieu sur Dolon (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 10/532,124

(22) PCT Filed: Jun. 29, 2004

(86) PCT No.: PCT/FR2004/001660

§ 371 (c)(1),
(2), (4) Date: Apr. 20, 2005

(87) PCT Pub. No.: WO2005/014916

PCT Pub. Date: Feb. 17, 2005

(65) Prior Publication Data

US 2006/0042133 A1 Mar. 2, 2006

(30) Foreign Application Priority Data

Jul. 11, 2003 (FR) ..... 03 08507

(51) Int. Cl.
*D06F 75/18* (2006.01)
*D06F 75/22* (2006.01)

(52) U.S. Cl. ..... 38/77.81

(58) Field of Classification Search ..... 38/77.2–77.5, 38/77.8, 77.81, 77.82, 77.83
See application file for complete search history.

(56) References Cited

U.S. PATENT DOCUMENTS

| | | | | |
|---|---|---|---|---|
| 2,387,281 | A * | 10/1945 | Morton | 38/77.7 |
| 2,456,490 | A * | 12/1948 | Busch et al. | 38/77.2 |
| 2,499,835 | A * | 3/1950 | Rakos | 38/77.7 |
| 2,762,143 | A * | 9/1956 | Hoecker | 38/77.5 |
| 3,418,736 | A | 12/1968 | Kueser | |
| 3,811,208 | A * | 5/1974 | Vieceli et al. | 38/77.8 |
| 5,063,697 | A * | 11/1991 | Valente et al. | 38/75 |
| 5,307,573 | A * | 5/1994 | Watkins | 38/77.8 |
| 6,745,504 | B1 * | 6/2004 | Sastre et al. | 38/77.82 |
| 2004/0050837 | A1 | 3/2004 | Bontems et al. | |
| 2004/0237357 | A1 | 12/2004 | Bontems et al. | |

FOREIGN PATENT DOCUMENTS

| | | |
|---|---|---|
| FR | 1217616 A | 5/1960 |
| FR | 2830266 A | 4/2003 |

* cited by examiner

*Primary Examiner*—Ismael Izaguirre
(74) *Attorney, Agent, or Firm*—Browdy and Neimark, PLLC

(57) ABSTRACT

The inventive steam iron comprises a water reservoir (3) provided with a filling orifice (5) arranged on the rear face of the iron in such a way that the reservoir (3) is filled when the iron is tilted forward. Said reservoir comprises a ventilation circuit provided with an end penetrating into the rear part of the reservoir (3) and an end communicating with external air and arranged on the top front part of the iron. The iron is characterised in that said ventilation circuit comprises a pipe (12) which has a small cross section, is introduced into the rear part of the reservoir (3) and is extended by a hollow end element (15) whose cross section is greater and which extends downwards and is provided with an opening in the lower part thereof.

11 Claims, 5 Drawing Sheets

IRON COMPRISING A WATER RESERVOIR WHICH IS PROVIDED WITH A FILLING ORIFICE ON THE REAR FACE OF SAID IRON

The present invention relates to a pressing iron and more particularly to a pressing iron having a water reservoir provided with a filling opening on the rear face of the iron.

There is known from patent application FR 2 830 266, filed by the applicant, a pressing iron having an opening for filling the reservoir placed at the level of the heel of the iron and oriented in a manner such that the filling of the reservoir is carried out by holding the pressing iron substantially vertically, the tip toward the bottom. Such an arrangement makes it possible to have a filling opening of significant size, free of any obstacle, which facilitates rapid filling of the reservoir, by placing it in particular directly under a tap. However, the reservoir of such an iron must be provided with a vent placed at the back of the reservoir, this vent having to be connected to a pipe emerging into the free air at the front of the iron, above the reservoir, so that the water in the reservoir does not run out through the vent when the iron is placed on its heel, on its soleplate or is rocked ahead.

However, such a vent circuit presents the disadvantage of permitting the water in the reservoir to rise naturally in the pipe of the vent circuit when the iron is posed on its heel. Thus, if the iron is then rocked forwards, water present in the pipe flows to the outside of the iron through the outlet of the vent, which is objectionable to the user.

It is thus preferable to use, for the vent circuit, a pipe of small cross section in order to reduce the volume of water contained in the latter. The use of a pipe of small cross section also has the advantage of reducing the space occupied by the pipe, which is particularly significant when the latter is placed in the reservoir. However, the applicant has realized that the use of a pipe of small cross section promotes adherence, by capillarity, of water drops to the walls of the pipe. These drops remain in the pipe instead of being evacuated into the reservoir when the iron is rocked from the vertical position, on its heel, to the horizontal position on its soleplate, and thus preventing the vent from completely fulfilling its role of venting the reservoir. The poor venting of the reservoir that results therefrom can lead to a halt of water flow towards the steam chamber of the pressing iron, in particular when the height of water in the reservoir becomes less significant, and to interrupt the production of steam while water remains in the reservoir.

Therefore, a goal of the present invention is to remedy these disadvantages by offering a pressing iron having a reservoir with filling at the rear provided with an improved vent circuit that ensures a good connection of the reservoir to the air while reducing the risks of flow of water out of the reservoir in the various functional positions of the iron.

To this end, the invention has as an object a pressing iron having a water reservoir provided with a filling opening located on the rear face of the iron so that filling of the reservoir is carried out by holding the iron rocked forwards, the reservoir having a vent circuit presenting an end opening at the rear part of the reservoir and an end, in contact with the surrounding air, located in the upper front part of the iron, characterized in that the vent circuit has a pipe of small cross section which opens in the upper rear part of the reservoir and is prolonged by a hollow end element, of larger cross section, extending downwardly and having an opening in its lower part.

Such a characteristic makes it possible to aspirate the water droplets present in the pipe of the vent circuit when the iron is rocked from the vertical position, on its heel, to the horizontal position on its soleplate. In effect, the water contained in the end element, when the iron is posed on its heel, descends like a piston into the bottom of the reservoir when the iron is rocked onto its soleplate, which causes the aspiration, like a pump, of water present in the pipe, thus eliminating the possible water drops attached by capillarity.

According to a particular mode of realization of the invention, the hollow end element has the form of a bell widening from the top to the bottom. Such a characteristic makes it possible to have a hollow end element presenting small overall dimensions in its upper part while having a significant internal volume;

According to another characteristic of the invention, the vent circuit has a buffer chamber interposed between the pipe and the end of the vent circuit in communication with the surrounding air, the buffer chamber being placed in the upper front part of the body of the iron in order to be above the maximum water level in the reservoir when the iron rests horizontally. Such a characteristic makes it possible to prevent water from escaping through the end of the vent circuit while collecting, in the buffer chamber, water present in the vent circuit when the iron is rocked forwards.

According to still another characteristic of the invention, the volume of the buffer chamber corresponds substantially to the volume of the pipe extending between the buffer chamber and the bell. Such a characteristic makes it possible to obtain a buffer chamber of small overall dimensions whose volume is optimized to limit the risks of flow of water outside of the vent circuit.

According to another characteristic of the invention, the filling opening of the reservoir is prolonged to the interior of the reservoir by a sleeve providing in the reservoir, outside the sleeve, a reserve of air. Such a characteristic has the advantage of providing a reserve of air that is difficult to fill with water during the filling of the reservoir.

According to still another characteristic of the invention, the bell is placed at the level of the reserve of air provided at both sides of the sleeve. Such a characteristic has the advantage of preventing water from penetrating into the bell and flowing into the vent circuit during the operation of filling the reservoir.

According to still another characteristic of the invention, the reservoir is in communication with a drip device plug feeding a steam chamber, the plug being fed by a channel whose rear end emerges inside the reservoir at the level of the lower rear part of the reservoir. Such a characteristic makes it possible to prevent water from flowing out prematurely past the drip device plug during the filling of the reservoir.

According to another characteristic of the invention, the rear end of the supply channel of the plug emerges into the air reserve provided at both sides of the sleeve. Such a characteristic makes it possible to further limit the risks of flow of water past the drip device plug during the filling of the reservoir.

One will better understand the goals, aspects and advantages of this invention, according to the description given hereafter of a particular embodiment of the invention presented as a nonlimiting example, while referring to the annexed drawings in which.

Figure 1:
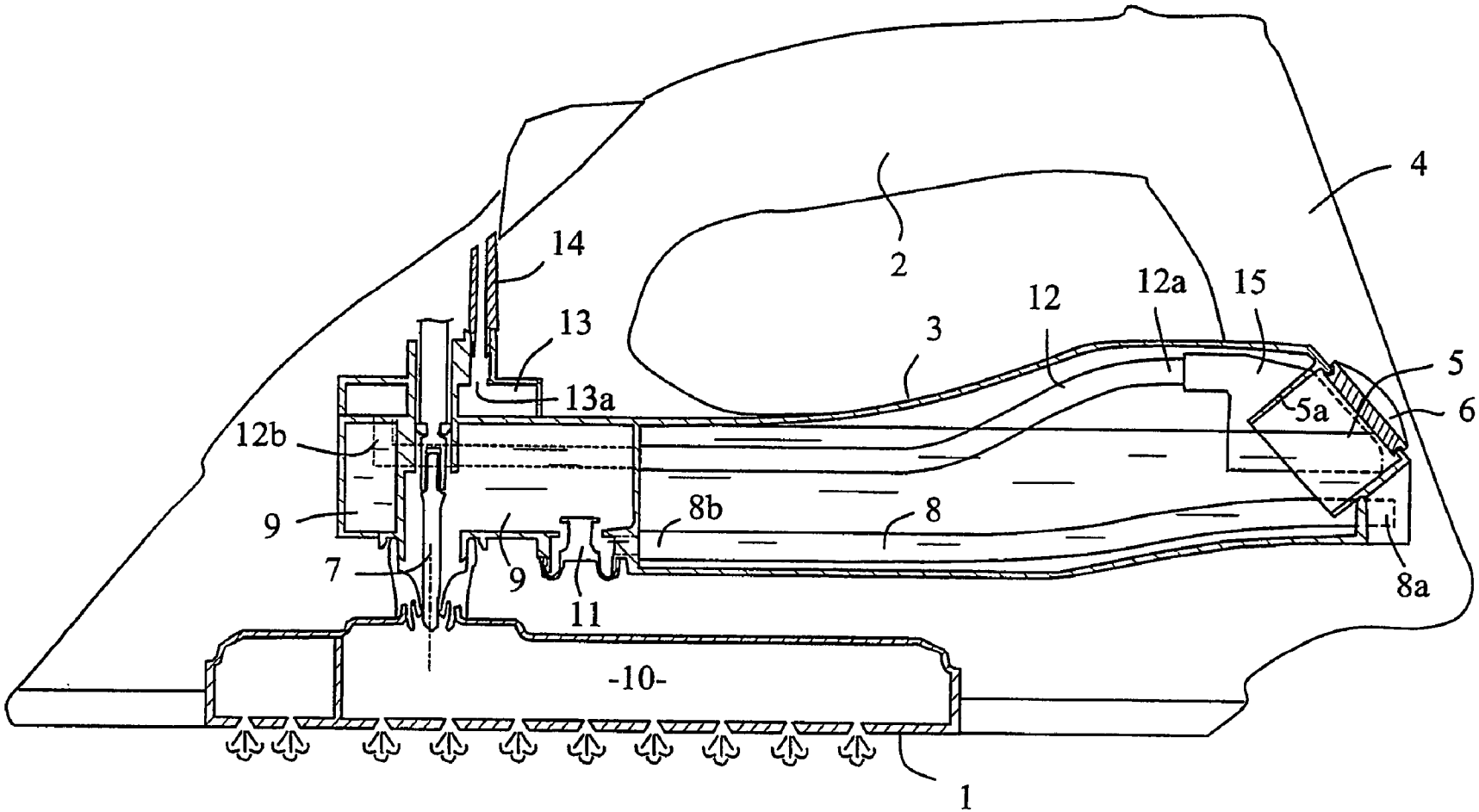
FIG. 1 is a general view, in longitudinal cross section, of a pressing iron according to a particular embodiment of the invention.
Figure 2:
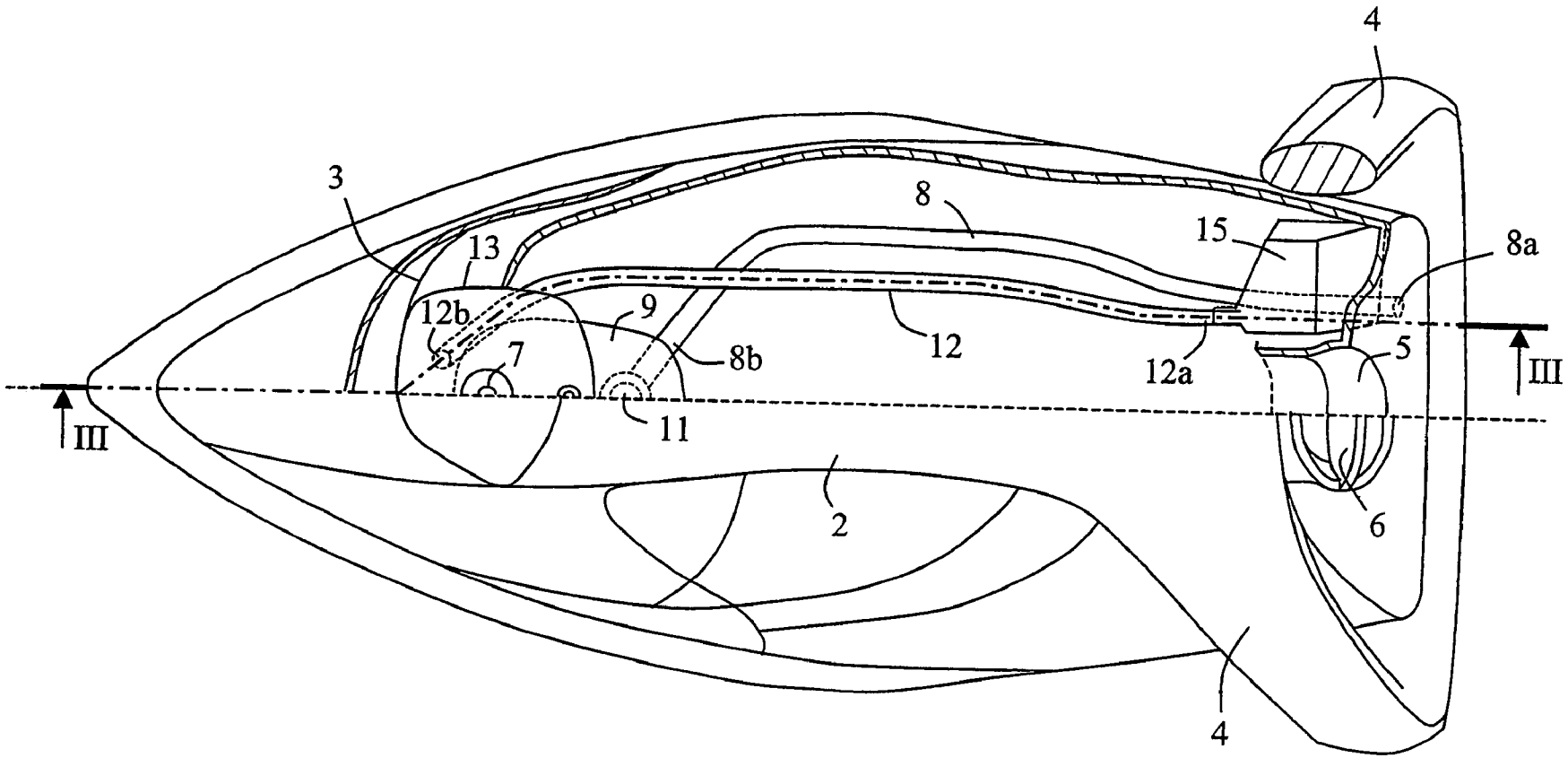
FIG. 2 is a top view of the pressing iron of FIG. 1 in which the upper half-view is represented partially broken away.

FIGS. 1 and 2 represent a diagrammatic view of a steam pressing iron having a heating soleplate 1, a handle 2 and a body integrating a water reservoir 3. Handle 2 is connected to the rear of the iron by two arms 4 extending, while diverging from handle 1, to the body of the iron so that the structure obtained is substantially triangulated and constitutes a heel on which the iron can rest.

Figure 5:
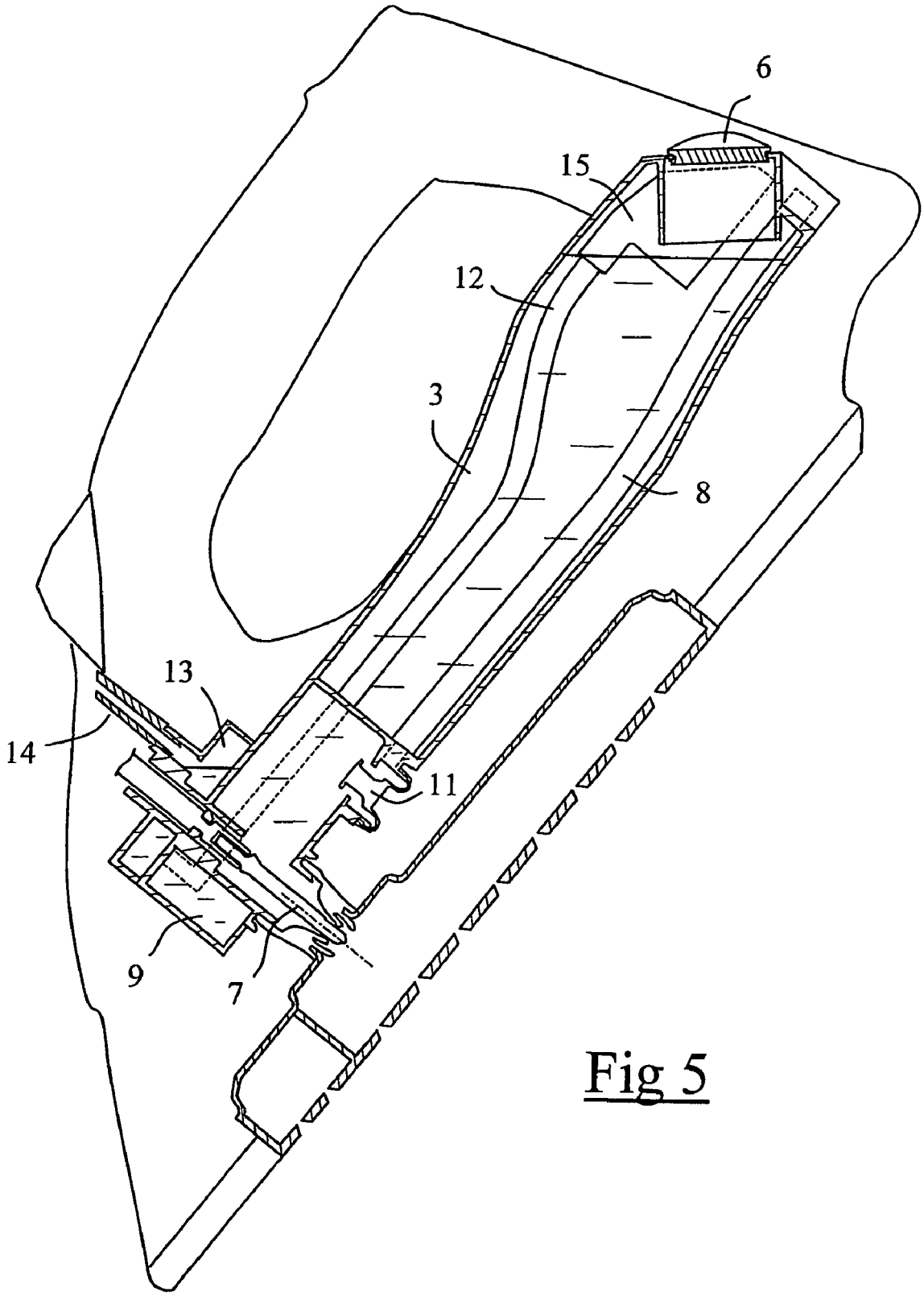
FIG. 5 is a view similar to FIG. 1, representing the iron in position rocked forwards, adapted for filling of the reservoir.

In accordance with FIG. 1, reservoir 3 of the iron comprises a filling opening 5 disposed on the rear face of the iron, between the two arms 4. Opening 5 is inclined towards the rear of the iron so that the filling of the iron is carried out by holding the iron rocked forward, as represented in FIG. 5.

Filling opening 5 is sealed by a removable stopper 6 and has a cylindrical sleeve 5*a*, in the axis of opening 5, extending over a few centimeters towards the interior of reservoir 3. The lower end of sleeve 5*a* delimits the maximum level of filling of reservoir 3 when the iron is in the filling position, rocked forwards. Moreover, in this filling position, sleeve 5*a* provides in reservoir 3, on both sides of the sleeve 5*a*, a volume that is difficult to fill with water, constituting a reserve of air.

Reservoir 3 is connected, by the intermediary of a supply tube 8, to a chamber 9 integrated in the front part of reservoir 3 and feeding a drip device plug 7 delivering water gradually into a steam chamber 10 integrated in heating soleplate 1.

Supply tube 8 extends to the bottom of reservoir 3 and has an end 8*a* opening freely to the rear of the reservoir, in the volume surrounding the sleeve 5*a*. The other end 8*b* of the supply tube is connected to a drip preventing valve 11 interposed between reservoir 3 and chamber 9 for supplying drip device plug 7. In a known way, drip preventing valve 11 is controlled by a control unit, not represented, ensuring the closing of the valve when the temperature of the steam chamber is not sufficient for the production of steam.

Figure 3:
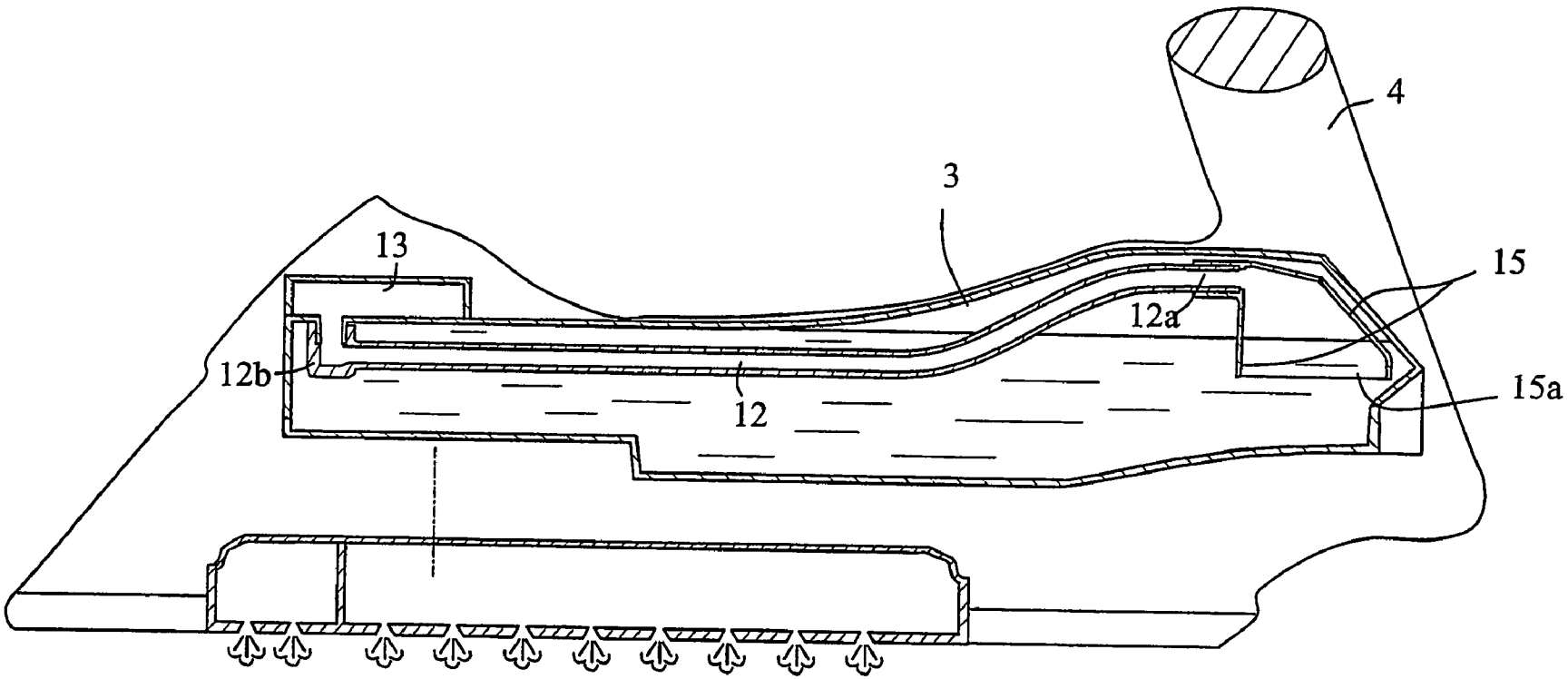
FIG. 3 is a cross-sectional view along line III-III of FIG. 2.

In accordance with FIGS. 1 to 3, reservoir 3 is provided with a vent circuit having a vent pipe 12, of small passage cross section, extending into reservoir 3, the internal diameter of vent pipe 12 being of the order of 4 mm. Vent pipe 12 has a rear end 12*a* opening into the upper rear part of reservoir 3 and a front end 12*b* connected to a buffer chamber 13 placed above reservoir 3, at the front end of the latter. Buffer chamber 13 has a volume substantially equal to the volume of water that can be contained in vent pipe 12 and has an upper wall provided with an opening 13*a* communicating with the surrounding air by the intermediary of a nozzle 14.

The rear end 12*a* of the vent pipe is connected to an element 15 in the shape of a bell widening progressively from the top to the bottom and presenting an opening 15*a* at its lower end disposed substantially at the middle of the height of reservoir 3. This bell 15 is placed as far behind reservoir 3 as possible so as to be submerged in the water of the reservoir when the iron is posed on its heel.

The operation of such a pressing iron and in particular the various flows occurring in the vent circuit and the circuit supplying the plug when the iron is placed on its heel, on its soleplate or rocked toward the front will now be described with reference to FIGS. 4 and 5.

Figure 4:
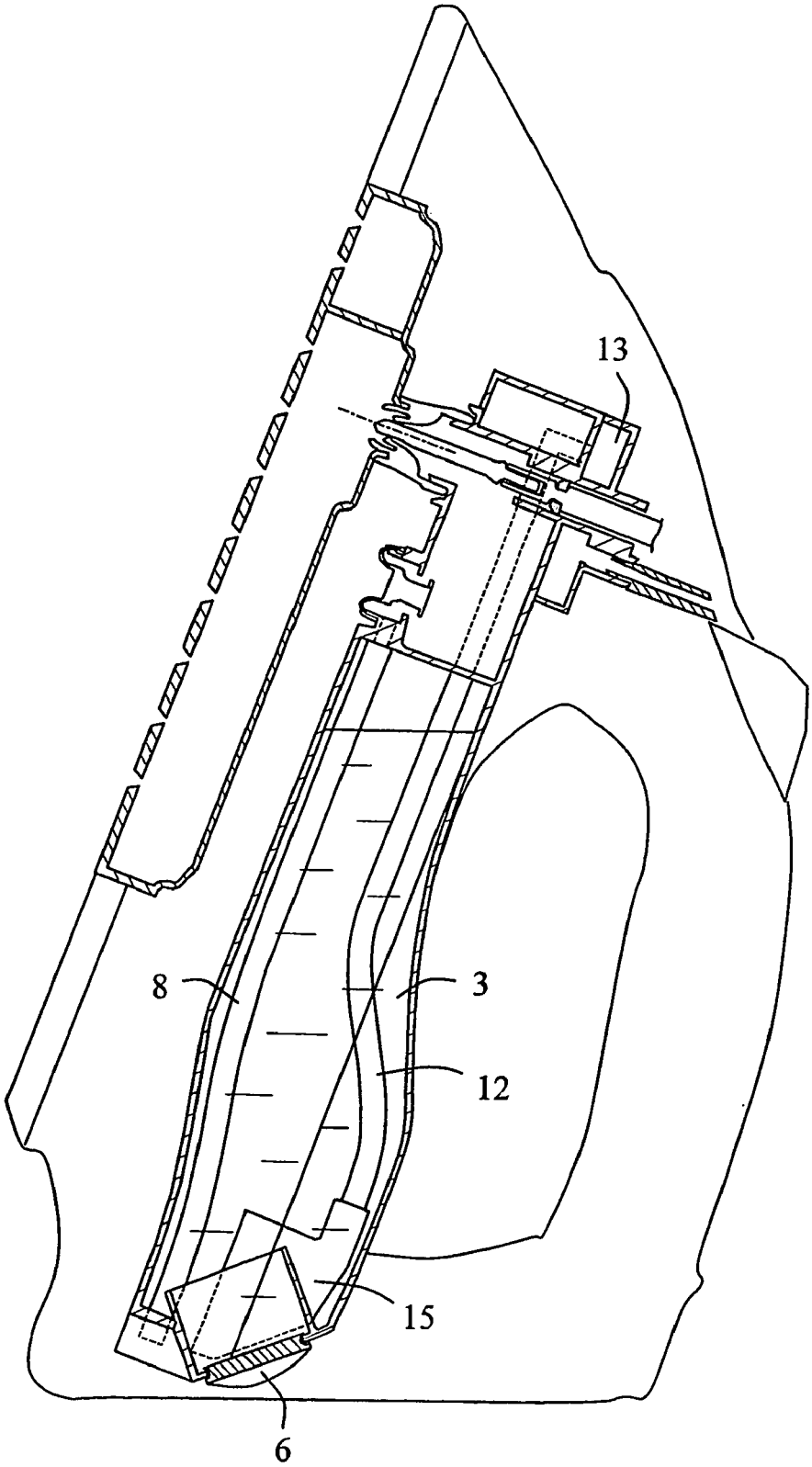
FIG. 4 is a view similar to FIG. 1 representating the iron resting on its heel.

FIG. 4 represents the iron in its vertical position on its heel. In this position, bell 15 is full of water and water rises through vent tube 12 until reaching equilibrium with the water level in the remainder of reservoir 3. If the iron is then brought back to the horizontal position, the water contained in bell 15 falls back to the bottom of reservoir 3, under the effect of gravity, while acting like a piston creating an aspiration in vent pipe 12. Vent pipe 12 is thus freed of possible water drops adhering by capillarity to its walls. Moreover, the aspiration created by the fall of the volume of water in the bell has the advantage of being maximum when that the water level in the reservoir becomes low, i.e. when it is necessary to have a good exposure of the reservoir to the air to ensure a good flow of water from the reservoir towards the steam chamber.

Bell 15 also has the advantage of having a breakwater effect that limits the rise of water in vent pipe 12 during the ironing phases where the iron is agitated from front to back in the horizontal position.

FIG. 5 represents the iron of FIG. 4 rocked forwards, in a position adapted for the filling of the reservoir.

In accordance with this figure, the presence of buffer chamber 13 makes it possible to prevent water from flowing through nozzle 14 of the vent circuit when the iron, the reservoir full, passes from the position resting on its heel to the rocked forward position represented in FIG. 5. This situation can in particular occur when the user wishes to put water in the reservoir when the latter is already full. In such a case, water being in vent pipe 12 is recovered in buffer chamber 13, when the iron is rocked forwards. When the iron is brought back to the horizontal position, water in buffer chamber 13 flows through the vent circuit to fall back into reservoir 3.

Lastly, supply tube 8 for plug 7 makes it possible, as for it, to prevent the reservoir from being emptied through drip device plug 7, if the latter remains open when the iron is rocked forward. In effect, the end of supply tube 8 opens at the rear of reservoir 3 in an air pocket created by the presence of sleeve 5*a*. Thus, only the small quantity of water present in supply tube 8 and supply chamber 9 can flow in the direction of steam chamber 10 when the iron is rocked forward.

Such a pressing iron thus has the advantage of having a reservoir filled at the rear having a vent circuit ensuring an excellent communication of the reservoir with the surrounding air and not permitting water to flow out of the reservoir through the vent circuit when the iron is placed on its heel, its soleplate or is rocked forward for filling the reservoir.

Of course, the invention is by no means limited to the embodiment described and illustrated which was given only by way of example. Modifications remain possible, in particular from the point of view of the constitution of the various elements or by substitution of technical equivalents, without departing as a result from the field protection of the invention.

The invention claimed is:

1. A pressing iron having a water reservoir (3) provided with a filling opening (5) located on the rear face of the iron so that filling of the reservoir (3) is carried out by holding the iron rocked forwards, the reservoir having a vent circuit presenting an end opening at the rear part of the reservoir (3) and an end, in contact with the surrounding air, located in the upper front part of the iron, characterized in that said vent circuit comprises a pipe (12) of small cross section which opens in the upper rear part of the reservoir (3) and is prolonged by a hollow end element (15), of larger cross section, extending downwardly and having an opening (15*a*) in its lower part.

2. The iron according to claim 1, characterized in that the end element (15) has the form of a bell widening from the top to the bottom.

3. The iron according to claim 2, characterized in that the vent circuit has a buffer chamber (13) interposed between the pipe (12) and the end of the vent circuit in communication with the surrounding air, said buffer chamber (13) being placed in the upper front part of the body of the iron in order to be above the maximum water level in the reservoir (3) when the iron rests horizontally.

4. The iron according to claim 3, characterized in that the volume of the buffer chamber (13) corresponds substantially to the volume of the pipe (12) extending between the buffer chamber (13) and the bell (15).

5. The iron according to claim 1, characterized in that the filling opening (5) of the reservoir (3) is prolonged to the interior of the reservoir by a sleeve (5*a*) providing in the reservoir (3), outside the sleeve (5*a*), a reserve of air during filling of the reservoir.

6. The iron according to claim 5, characterized in that the end element (15) has the form of a bell widening from the top to the bottom, and the he bell (15) is placed in the reserve of air provided at both sides of the sleeve.

7. The iron according to claim 5, characterized in that said reservoir (3) is in communication with a drip device plug (7) feeding a steam chamber (10), said plug (7) being fed by a channel (8) whose rear end (8*a*) emerges inside the reservoir (3) at the level of the lower rear part of the reservoir (3).

8. The iron according to claim 7, characterized in that said rear end (8*a*) of the channel (8) emerges into the air reserve provided at both sides of the sleeve (5*a*).

9. The iron according to claim 1, characterized in that the vent circuit has a buffer chamber (13) interposed between the pipe (12) and the end of the vent circuit in communication with the surrounding air, said buffer chamber (13) being placed in the upper front part of the body of the iron in order to be above the maximum water level in the reservoir (3) when the iron rests horizontally.

10. The iron according to claim 1, characterized in that said reservoir (3) is in communication with a drip device plug (7) feeding a steam chamber (10), said plug (7) being fed by a channel (8) whose rear end (8*a*) emerges inside the reservoir (3) at the level of the lower rear part of the reservoir (3).

11. The iron according to claim 1, further comprising a removable stopper for closing said filling opening when said iron is in use.

* * * * *